United States Patent [19]

Dahlquist et al.

[11] Patent Number: 4,954,041

[45] Date of Patent: Sep. 4, 1990

[54] TRIPLE SECTION TELESCOPIC BOOM MATERIALS HANDLING VEHICLE

[75] Inventors: E. Arthur Dahlquist, Burnville; Allan D. Jenkins, Maple Plain; David C. Truehart, Lakeville; Richard B. Baxter, Two Harbors, all of Minn.

[73] Assignee: Lull Corp., St. Paul, Minn.

[21] Appl. No.: 356,804

[22] Filed: May 24, 1989

Related U.S. Application Data

[63] Continuation of Ser. No. 111,823, Oct. 21, 1987, abandoned.

[51] Int. Cl.[5] ..... B66F 9/06

[52] U.S. Cl. ..... 414/718; 212/264; 212/268; 414/722

[58] Field of Search ..... 414/718, 722, 723, 728; 212/189, 267, 268, 264

[56] References Cited

U.S. PATENT DOCUMENTS

| | | | |
|---|---|---|---|
| 1,319,888 | 10/1919 | Miller . | |
| 2,628,870 | 2/1953 | Hickman | 403/158 X |
| 3,170,580 | 2/1965 | Soyko | 214/302 |
| 3,178,046 | 4/1965 | Lull | 214/141 |
| 3,198,359 | 8/1965 | Lull | 214/140 |
| 3,423,890 | 1/1969 | Leigh | 52/118 |
| 3,478,894 | 11/1969 | Stauffer | 212/55 |
| 3,530,493 | 9/1970 | Hollnagel et al. | 188/72.4 |
| 3,572,528 | 3/1971 | Morton et al. | 214/145 |
| 3,688,930 | 9/1972 | Shumaker | 214/141 |
| 3,836,011 | 9/1974 | Sakamoto et al. | 212/144 |
| 3,934,738 | 1/1976 | Arnold | 414/723 |
| 3,967,744 | 7/1976 | Goyarts | 214/770 |
| 3,985,248 | 10/1976 | Leigel et al. | 214/141 |
| 4,016,688 | 4/1977 | Tiffin et al. | 414/718 X |
| 4,082,197 | 4/1978 | Stedman | 414/718 X |
| 4,147,263 | 4/1979 | Federick et al. | 414/728 X |
| 4,251,181 | 2/1981 | Drott et al. | 414/723 |
| 4,380,244 | 4/1983 | Caudill et al. | 414/718 X |
| 4,434,902 | 3/1984 | Goode et al. | 212/268 |
| 4,518,090 | 5/1985 | Thomasson | 212/189 |
| 4,607,977 | 8/1986 | Varnelis et al. | 403/158 X |

OTHER PUBLICATIONS

Sellick Maxi-Reach V Brochure, #MR 6688-86.
Sellick Teleporter Brochure, #Tel-11-85.

*Primary Examiner*—Robert J. Spar
*Assistant Examiner*—Donald W. Underwood
*Attorney, Agent, or Firm*—Pennie & Edmonds

[57] ABSTRACT

A variable reach rough terrain load lifting apparatus comprising a vehicle having a frame; a boom having innermost, intermediate and outermost telescoping boom segments; and means for pivotally connecting the outermost boom segment to the vehicle frame and capable of reciprocal longitudinal movement therewith. The outermost boom segment has first and second hydraulic cylinders mounted therein for extending and retracting the intermediate and innermost boom segments, respectively. The pivotal connection means facilitates pivotal movement of the boom with respect to the vehicle while preventing buildup of corrosion products which would interfere therewith and further to facilitate repair or replacement thereof due to normal operation. The innermost boom includes end effector means attached to the forward end thereof by means for quick connection and disconnection. A pair of outriggers are located on opposite sides of the front of the vehicle for providing upward stabilizing forces to the front end of the vehicle when the boom is extended at maximum loads.

31 Claims, 13 Drawing Sheets

TRIPLE SECTION TELESCOPIC BOOM MATERIALS HANDLING VEHICLE

This is a continuation of application Ser. No. 07/111,823 filed Oct. 21, 1987, abandoned.

TECHNICAL FIELD

The invention relates to mobile materials handling devices generally referred to as variable reach rough terrain forklifts and in particular to one having a triple section telescopic boom and extended transfer means.

BACKGROUND ART

Materials handling vehicles which are known and referred to as mobile high lift loaders are used for material handling jobs that require placing of a load in positions beyond the immediate area of the loader. For example, in construction jobs, it is desirable to lift heavy loads such as bricks and other materials and place them on floors within the building under construction which requires movement of the load high above and forward from the loader. For some purposes, it is necessary to reach to a level below that on which the loader rests. A reaching action is often necessary in the unloading of trucks or railroad cars, in the handling of lumber, logs, and the like.

Lull U.S. Pat. No. 3,198,359 discloses one type of reaching loader in which the ends of lift arms can be moved forward of the loader by means of a longitudinally movable carriage to which the lift arms are pivotally secured. This construction separates the reaching action from the raising and lowering action and eliminates many of the disadvantages of earlier loaders. However, the height to which loads may be lifted is limited by the length of the lift arms, and the distance of longitudinal transfer is limited relative to the length of the vehicle.

Goyarts U.S. Pat. No. 3,967,744 discloses a loader in which a load handling device is carried at the end of a boom which in turn is pivotally mounted on a trolley adapted to travel longitudinally along a second boom pivotally secured to the carrier vehicle. This type of loader permits reaching by virtue of the longitudinal travel of the trolley and permits some additional lifting height by virtue of the pivotal movement of the second boom relative to the vehicle. However, here too the lifting height is limited by virtue of the fixed length of the boom supporting the load lifting mechanism.

Lull U.S. Pat. No. 3,178,046 discloses a reaching loader in which the load carrying means is supported at the end of a telescopic boom pivotally secured to a vehicle. Extended reach is accomplished by extension of the telescopic boom, but both reach and lifting height are limited by the length of that boom.

Lull U.S. Pat. No. 4,147,263 discloses a loader having extended transfer with the load carrying means supported at the end of a telescopic boom which is pivotally secured to transfer means, preferably in the form of a transfer carriage. The transfer means can move the telescopic boom forward and rearward in addition to the reach attainable by extension, retraction, lifting and lowering of the boom.

Triple section telescopic booms are also generally known in the prior art. For example, Lull Model 1522 includes a triple section telescopic boom on a reaching loader wherein the boom is pivotally secured to directly to the vehicle. While an extended reach is accomplished by extension, retraction, lifting and lowering of the boom, the reach and lifting height are limited by the length of that boom and the vehicle must be substantially reinforced to prevent tipover when the boom is fully extended and carrying loads near its maximum weight handling capacity.

The present invention resolves the deficiencies of the prior art and provides a versatile, stable, variable reach rough terrain load lifting apparatus which is a substantial technological advance over existing devices.

SUMMARY OF THE INVENTION

The invention relates to a variable reach rough terrain load lifting apparatus comprising a vehicle having a frame; a boom comprising innermost, intermediate and outermost telescoping boom segments; means for elevating and lowering the boom; means for pivotal connection of the boom to the vehicle frame; means for reciprocating longitudinal movement of both the boom and pivotal connection means with respect to the vehicle frame; and means for stabilizing the vehicle when the boom is extended.

The outermost boom segment has first and second hydraulic cylinders mounted therein, with the first hydraulic cylinder connecting the outermost and intermediate boom segments for extending and retracting the intermediate boom segment, and the second hydraulic cylinder connecting the outermost and innermost boom segments for extending and retracting the innermost boom segment. The pivotal connection means facilitates pivotal movement of the boom with respect to the vehicle while preventing buildup of corrosion products which would interfere therewith and further facilitates its repair or replacement due to normal operation. Also, the innermost boom segment includes end effector means attached to the forward end thereof.

The apparatus further comprises means for maintaining the end effector means at a predetermined attitude with respect to the vehicle frame, as well as means for quick connection and disconnection to and from the forward end of the innermost boom segment. Preferably, the means for elevating and lowering the boom comprises a pair of hydraulic cylinders each connected to an outer portion of the outermost boom segment.

The reciprocating longitudinal movement means comprises a transfer carriage mounted upon the vehicle frame for reciprocating longitudinal movement therewith with the boom being pivotally connected to the transfer carriage. In this arrangement, the vehicle frame includes two pair of track rails for supporting the transfer carriage to facilitate the reciprocating longitudinal movement between the carriage and vehicle frame.

Fluid pressure actuating means at the forward end of the innermost boom segment are also contemplated for operating the end effector means. Thus, fluid conduit means extending through the boom segments from a source of fluid under pressure in the vehicle to the fluid pressure actuating means is used, with at least a portion of the fluid conduit means being flexible hose. The apparatus also includes means for preventing the entanglement of the flexible hose when the innermost and intermediate boom segments are extended or retracted, such hose entanglement prevention means having at least one pulley assembly rotatably attached to the intermediate boom segment for engaging the flexible hose. This pulley assembly preferably comprises a pair of hose pulleys attached to a rear portion of the intermediate boom segment.

In addition, there is provided means for interconnecting the innermost, intermediate and outermost boom segments so that the innermost and intermediate boom segments can be extended or retracted in unison. The interconnection means includes means for maintaining tension between the outermost, intermediate and innermost boom segments, such means preferably being cable means operatively associated with pulley means mounted upon the intermediate boom segment. Suitable cable means includes a pair of cables each attached at one end to the outermost boom segment and at the other end to the innermost boom segment, with each of these cables engaging a pulley rotatably attached to the intermediate boom segment.

The pivotal connection means preferably comprises a pair of spaced bushings located in an elongated opening in the outermost boom segment, and a pin extending through the elongated opening and connected at each end to support means capable of reciprocating longitudinal movement with and mounted upon the vehicle frame.

The most advantageous stabilizing means comprises a pair of outriggers located on opposite sides of the front of the vehicle frame. Each outrigger preferably comprises a hydraulic cylinder and support pad arrangement, wherein the extension of the cylinder causes the support pad to contact a support surface for providing upward stabilizing forces to the front end of the vehicle.

A preferred quick connection and disconnecting means comprises rod means attached to the end effector means; U-shaped engagement means attached to the forward end of the innermost boom segment for receiving the rod means; and means for locking the end effector means to the innermost boom segment after the engagement means receives the rod means and when the end effector means is positioned in alignment with the innermost boom segment. The locking means includes a pair of pins each of which is movable by hydraulic means to engage a pair of apertures: one located on the end effector means and one on the boom forward end.

BRIEF DESCRIPTION OF THE DRAWINGS

This invention is illustrated in the accompanying drawings in which corresponding parts are identified by the same numerals and in which.

DETAILED DESCRIPTION OF THE PREFERRED EMBODIMENTS

Figure 1:
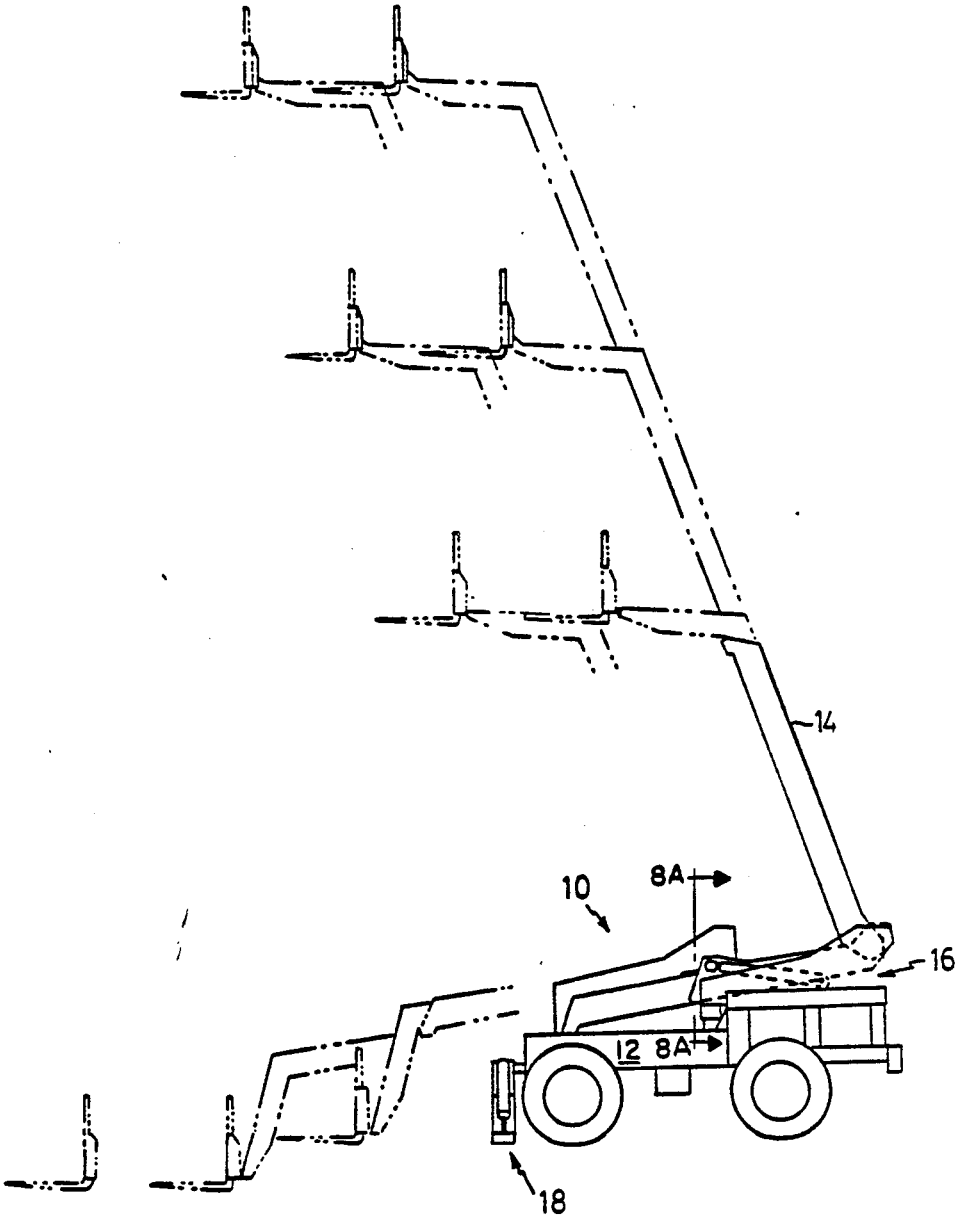
FIG. 1 is a side view of the triple section telescopic boom materials handling vehicle of the invention to illustrate its load lifting and delivery range.

The variable reach rough terrain load lifting apparatus of the present invention generally includes a motorized four-wheeled vehicle lo having a unitized frame 12 as illustrated in FIG. 1, which is a schematic of the reach capabilities thereof. The triple section boom 14 can be extended over a range from about 4 feet below grade to about 42 feet upwardly, while the transfer carriage 16 enables reciprocating longitudinal movement over a distance of about 80 inches, in addition to the reach due solely to the extension of the boom 14, which reach is about 35 feet. A pair of outriggers 18 are provided on each side of the front of the vehicle frame 12 for stabilizing the vehicle when the boom is fully extended at maximum loading, i.e., when moving a load of about 2,000 pounds with the boom fully extended. Generally, the vehicle can handle loads of up to about 10,000 pounds. The outline of the boom 14 in phantom shows the range of positions which can be achieved during operation.

In one preferred embodiment, the vehicle 10 includes a transfer carriage and track rail arrangement as disclosed in Lull U.S. Pat. No. 4,147,263, the content of which is expressly incorporated herein by reference thereto. Other arrangements for achieving reciprocal longitudinal movement of the boom can be used, if desired, such as that disclosed in the Maxi-Reach Model Nos. Super 66 and Super 88, available from Sellick Manufacturing, Ltd., Harrow, Ontario, Canada. In the transfer carriage/track rail embodiment, the rearward portion of the frame over the vehicle engine supports a first pair of parallel spaced apart horizontal longitudinal tracks. The forward portion of the frame supports a second pair of parallel spaced apart horizontal longitudinal tracks spaced somewhat lower than the first pair of tracks and preferably spaced inwardly therefrom. A transfer carriage is mounted for longitudinal reciprocal movement on the tracks and is provided with means for reciprocating the carriage between extended and retraced positions. Thus, the transfer carriage supports an elongated boom composed of at least three telescoping boom segments. The boom is pivotally secured to the carriage at one end and pivotally supports load handling means such as a fork lift, crane hook, grapple, or the like, at the other end. Power means are provided for elevating and lowering the boom relative to the carriage and for extending and retracting the boom segments. The various power means can be actuated selectively to extend and retract the boom, to raise and lower the boom, and to extend and retract the transfer carriage relative to the vehicle. The apparatus has good stability in various load handling positions. It has the capability of maximum forward extension of the load handling device, combined with maximum vertical lift to achieve the dimensions previously stated.

Figure 2:
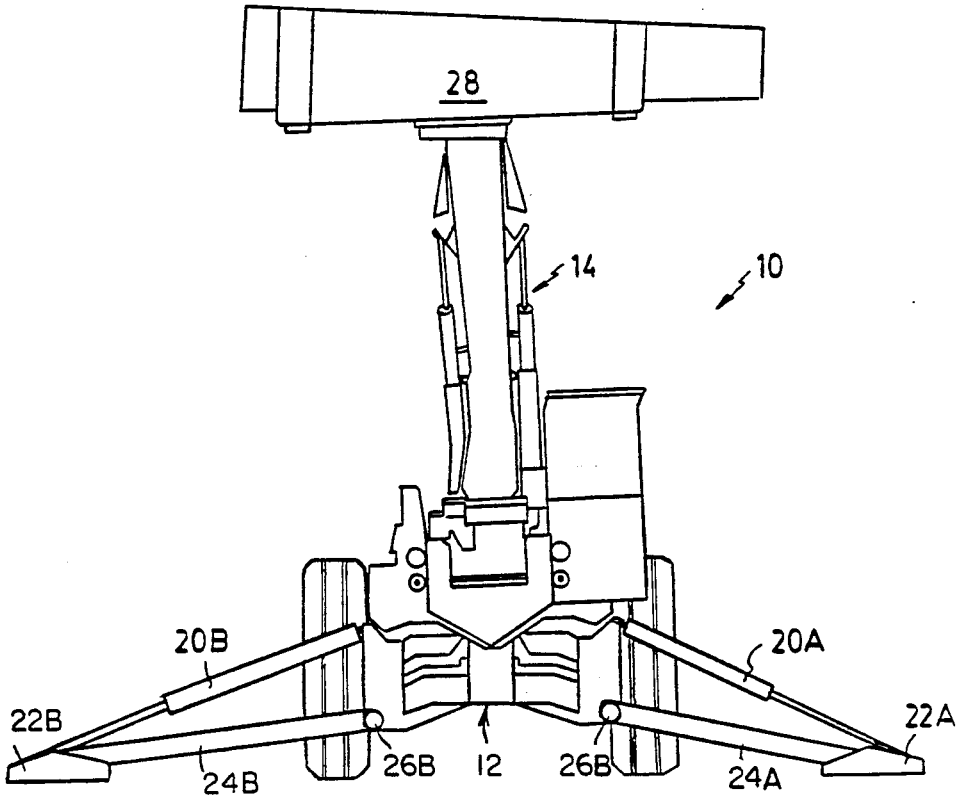
FIG. 2 is a front view of the materials handling vehicle of FIG. 1 showing the front end outrigger stabilizers.

FIG. 2 illustrates the outriggers 18 in their extended positions for providing upward stabilizing forces to the front of the vehicle frame 12. These outriggers 18 each include a hydraulic cylinder and piston arrangement 20A and 20B for extension and retraction of a support pad 22A and 22B, which is attached to the vehicle frame 12 by arms 24A and 24B through a pivot point 26A and 26B. As shown in the FIG., the outriggers 18 stabilize the vehicle when a load 28 is being transported by the boom. Also, the outriggers 18 operate independently so that the vehicle may be stabilized on a sloped or uneven grade. Also, as disclosed in Lull U.S. Pat. No. 4,147,263, the entire frame 12 may be pivoted relative to the wheels and axles on a longitudinal axis to facilitate use of the vehicle on slopes or other non-level terrain.

Figure 3:
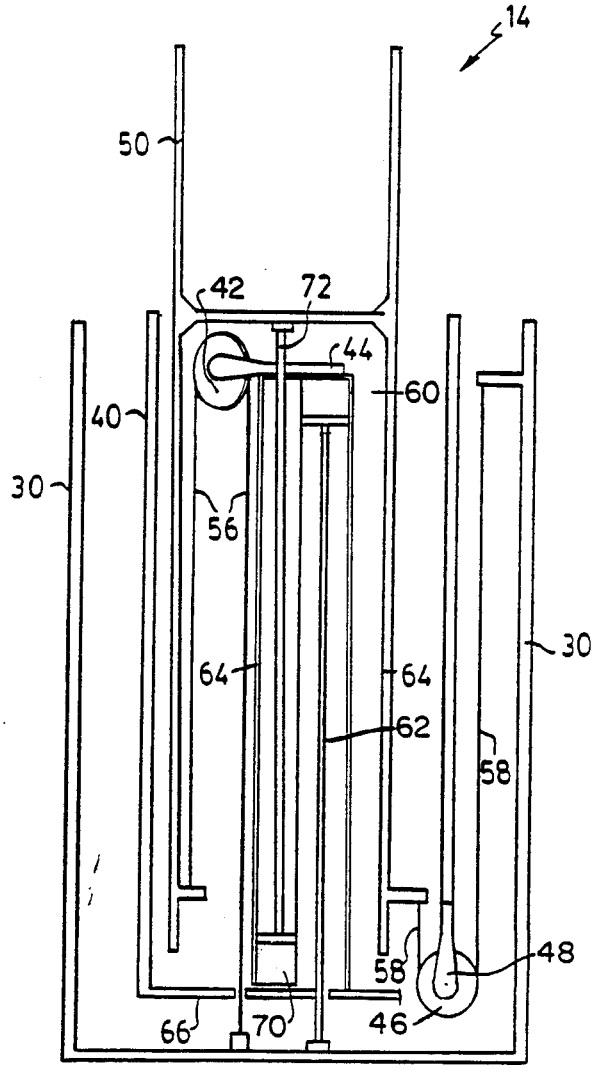
FIG. 3 is a schematic of the triple section telescopic boom.

FIGS. 3–8 illustrate the triple section telescopic boom of the invention. FIG. 3 schematically shows the connection and interrelationships between the various boom segments to illustrate their operation and relative movement. The boom 14 includes three telescopic boom segments outermost boom segment 30, intermediate boom segment 40, and innermost boom segment 50. Outermost boom segment 30, which is pivotally secured to the vehicle 10 in a manner which allows reciprocating longitudinal movement between the boom and the vehicle frame 12 as will be explained hereinbelow, houses intermediate boom segment 40 and innermost boom segment 50, as well as intermediate boom extension means and innermost boom extension means. The intermediate boom extension means includes a hydraulic cylinder 60 and piston 62 arrangement wherein the piston 62 is connected to the outermost boom segment 30, and the cylinder 60 is attached to the intermediate boom segment 40 by frame 64. Also, this intermediate boom segment 40 includes a pulley 42 rotatably mounted upon bracket 44 attached to frame 64 to facilitate a first tension connection between innermost boom segment 50 and outermost boom segment 30 by the use of a cable 56. Similarly, pulley 46 is attached to intermediate boom segment 40 by bracket 48 to facilitate a second tension connection between the innermost boom segment 50 and outermost boom segment 30, again by the use of a cable 58. The innermost boom segment extension means includes a hydraulic cylinder 70 and piston 72 arrangement wherein the piston 72 is connected to the innermost boom segment 50 and the cylinder 70 is attached to the intermediate boom segment 40. As shown more clearly in other drawing figures, cylinders 60 and 70 are maintained in vertical adjacent relation, preferably by being bolted together, in a manner such that pistons 62 and 72 extend in opposite directions. The intermediate and innermost boom extension means operate in unison with the tension cables 56, 58 to simultaneously extend or retract the intermediate and innermost boom segments 40, 50, with the outermost boom segment 30 remaining stationary.

Figure 4:
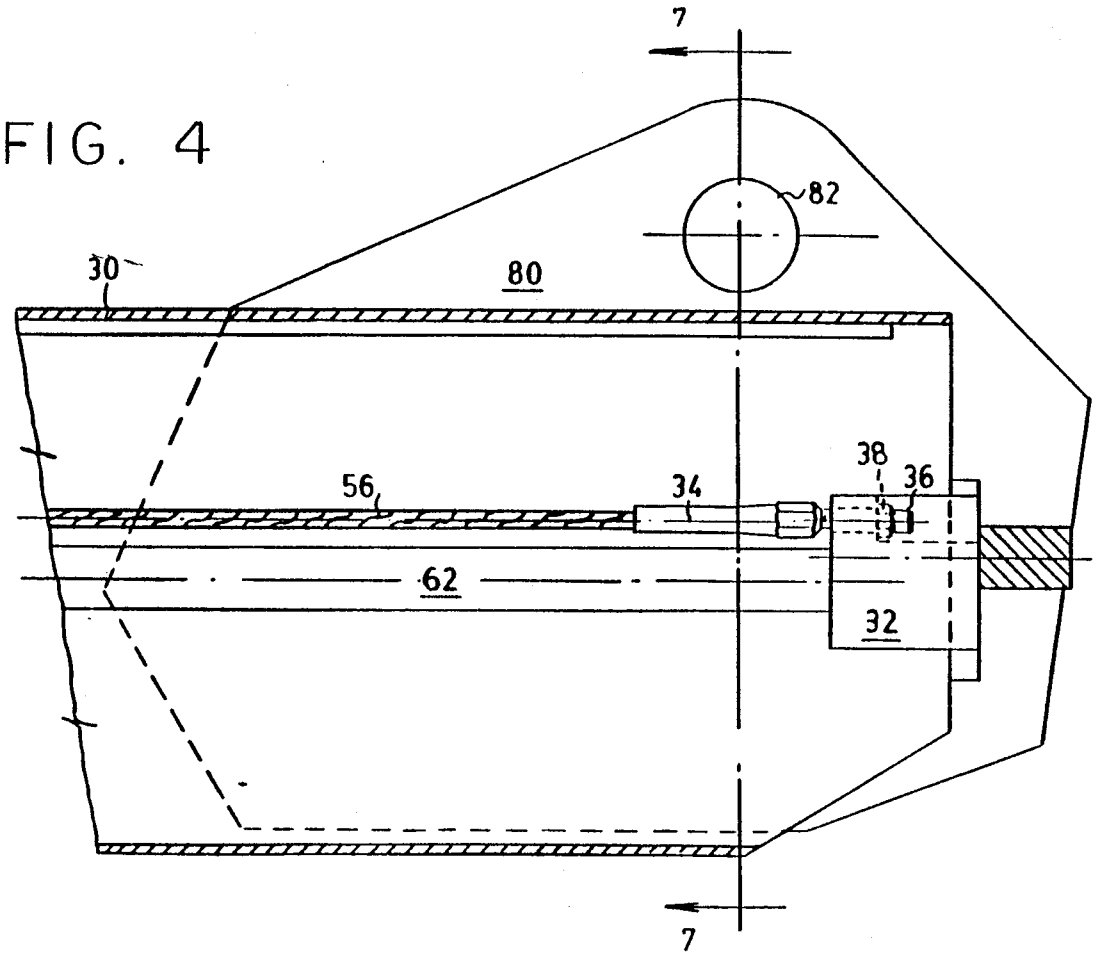
FIG. 4 is a cross sectional view of the rear portion of the outermost boom segment.
Figure 5:
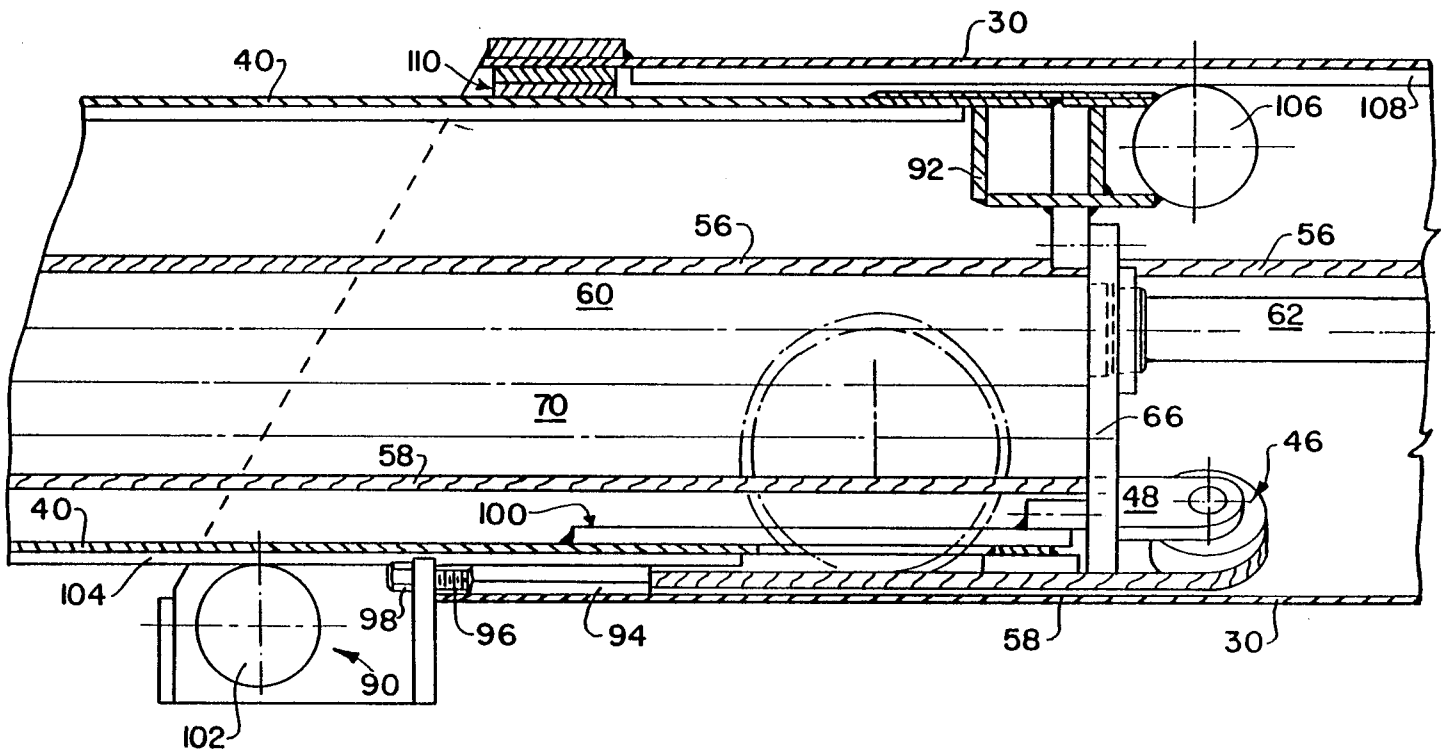
FIG. 5 is a cross sectional view of the transition area between the outermost and intermediate boom segments.
Figure 6:
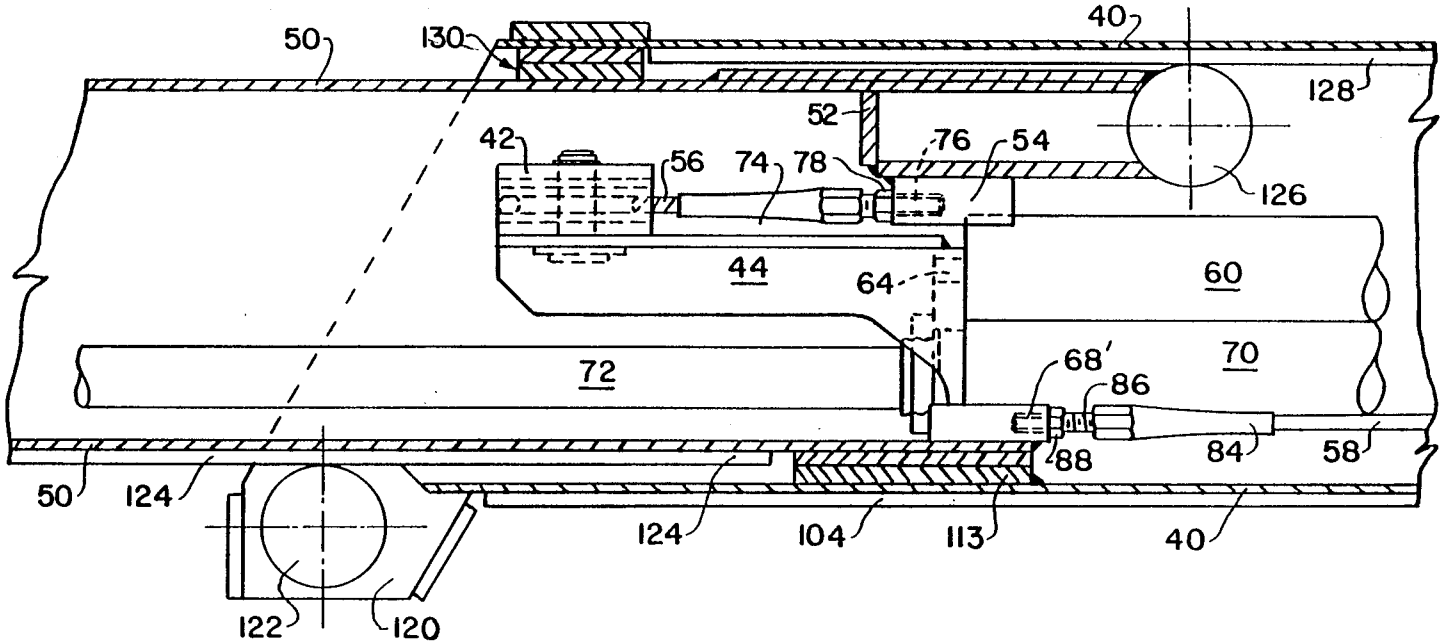
FIG. 6 is a cross sectional view of the transition area between the intermediate and innermost boom segments.

FIGS. 4–6 are detailed views of the outermost, intermediate and innermost boom segments 30, 40, 50 and the connections therebetween when the boom 14 is extended. In FIG. 4, outermost boom segment 30 and the connection of cable 56 thereto are shown, along with piston 62 and support flange 80, which includes aperture 82 for receiving a pin member forming part of a pivotal connection to the transfer carriage as will be explained further in the description of FIG. 8. Cable 56 includes end section 34 which has a threaded portion 36 to allow connection of cable 56 to bracket 32 by nut 38. Bracket 32 is mounted in a secure manner to outermost boom segment 30 by welding or the like.

Referring now to FIG. 5, there is illustrated the relationship between the outermost and intermediate boom segments 30, 40. Hydraulic cylinders 60, 70 are connected together by mounting plate 66, which is secured to the rear end of intermediate boom segment 40 through frame members 92, 100. Piston 62 (see FIG. 4) extends from cylinder 60 to the rear end of the outermost boom segment 30, where it is fixedly attached for causing extension and retraction of intermediate boom section 40 by exerting forces against outermost boom segment 30. Also, connected to mounting plate 66 is bracket 48 upon which pulley 46 is rotatably mounted. Cable 58 includes end section 94 having threaded portion 96 for connection to flange assembly 90 by nut 98.

Intermediate boom segment 40 is guided for movement within and forwardly outwardly from outermost boom segment 30 by a pair of spaced rollers 102 journaled in flange assembly 90 on the underside of the forward end of the outermost boom segment 30. Flange assembly 90 forms part of the lower front end of outermost boom segment 30. Rollers 102 engage spaced apart longitudinal wear pads 104 carried on opposite sides of the underside of intermediate boom segment 40. The intermediate boom segment 40 is also guided by a pair of rollers 106 mounted on a shaft carried by frame 92 at the rearmost end of intermediate boom section 40. These rollers 106 are journaled for rotation in engagement with spaced apart parallel longitudinal wear pads 108 carried on the inside top surface of outermost boom segment 30. Rollers 102, 106 have peripheral flanges which bear against wear pads 104, 108, respectively, to take up side thrust. A wear resistant cushion block 100 affixed to the under surface of the front end of outermost boom segment 30 in sliding engagement with the outer top surface of the intermediate boom segment 40 maintains rollers 106 in engagement with wear pads 128 regardless of the weight of the load carried by the boom 14.

FIG. 6 details certain connections in the section between the intermediate and innermost boom segments 40, 50. As noted above, hydraulic cylinders 60, 70 are mounted in adjacent vertical relation, and are connected together by bolting or the like. Piston 72 extends from cylinder 70 to the front end of innermost boom segment 50, where it is fixed to a bracket for extension and retraction of the innermost boom segment 50 in a manner similar to that disclosed in Lull U.S. Patent No. 4,147,263. Pulley 42 is mounted on the forward portion of frame 64 which is attached to intermediate boom segment 40. Cable 56 extends around pulley 42 and includes end section 74 which has a threaded portion 76 to allow connection to bracket 54 by nut 78. Bracket 64 is securely attached to innermost boom segment 50 by welding or the like to bracket support 52. Similarly, cable 58 includes end section 84 and threaded portion 86 for connection to bracket 68 by nut 88, while bracket 68 is welded to innermost boom segment 50, again by welding.

Innermost boom segment 50 is guided for movement within and forwardly outwardly from intermediate boom segment 40 by a pair of spaced rollers 122 journaled in a flange assembly 120 on the underside of the forward end of intermediate boom segment 40. Rollers 122 engage spaced apart longitudinal wear pads 124 carried on opposite sides of the underside of innermost boom segment 50. The innermost boom segment 50 is also guided by a pair of rollers 126 mounted on a shaft carried by frame 52 at the rearmost end of innermost boom segment 50. These rollers 126 are journaled for rotation in engagement with spaced apart parallel longitudinal wear pads 128 carried on the inside top surface of intermediate boom segment 40. Rollers 122, 126 have peripheral flanges which bear against wear pads 124, 128 respectively to take up side thrust. A wear resistant cushion block 130 affixed to the under surface of the frontward end of the intermediate boom segment 40 in sliding engagement with the outer top surface of the innermost boom segment 50 maintains rollers 126 in engagement with wear pad 128 regardless of the weight of the load carried by the boom 14. Another wear resistant cushion block 113 is affixed to the frontward end of the intermediate boom 40 to facilitate sliding engagement of inner boom 50 thereupon during extension and retraction thereof.

High strength steel is used in the boom structure for minimum lost load and increased capacity. The boom and transfer carriage are provided with hardened flange or shouldered rollers to bear against side members and to take up side thrust. Each boom segment is preferably constructed from a pair of U-shaped channel members having spaced apart recesses formed where wall segments are removed from the spaced apart free edges of the channel. The channel members in face-to-face abutment are then welded together along the neutral axis with oppositely spaced apart longitudinal weld lines between the open spaces. This form of construction facilitates assembly, materially reduces the boom weight and provides access ports for assembly, inspection, repair and service of interior boom parts. The wear-pads are of a hardened material welded to the boom segments to engage rollers for relative movement of the boom segments and to increase the boom strength and its resistance to buckling, while the cushion blocks are preferably made of Oilon PV-80, a polyacetal based oil containing plastic specifically designed to provide uniform lubrication.

Figure 7:
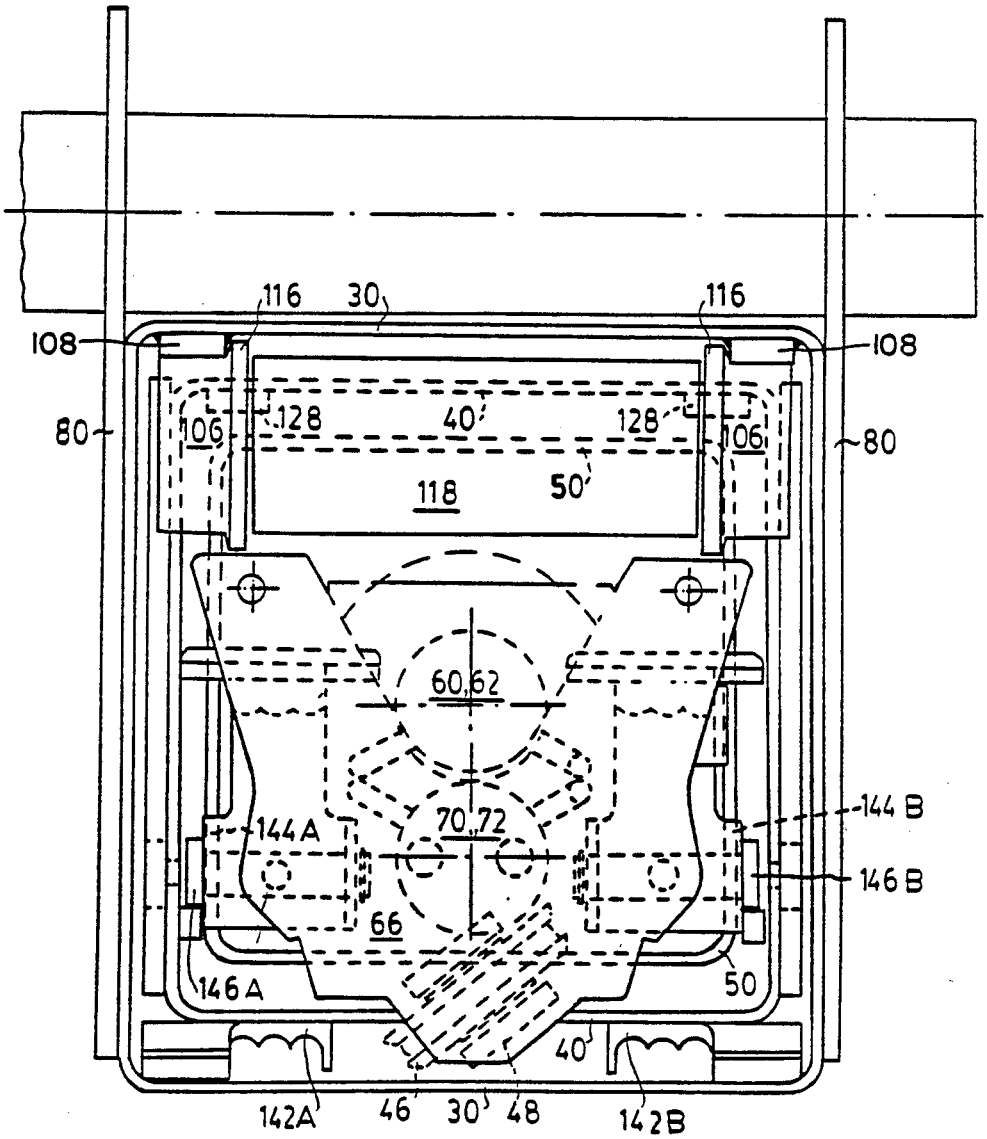
FIG. 7 is a view of the triple section boom in its retracted position taken along line 7—7 of FIG. 4.

FIG. 7 is an end view of the boom 14 when fully retracted to illustrate the position of the various components. As shown, flanged rollers 106, which are attached to the rearward end of intermediate boom segment 40 engage wear pads 108 with the flanged portion 116 of these rollers 106 engaging the respective side of the wear pads 108 to prevent side thrust as previously explained. These rollers 106 are maintained in the appropriate location by bushing 118. Although not illustrated in FIG. 7, flanged rollers 126, which are attached to the rearward end of innermost boom segment 50, engage wear pads 128 in a similar manner. This FIG. also illustrates the position of hose pulleys 142A, 142B and cable pulley 46, with respect to hydraulic cylinders 60, 70 and pistons 62, 72. Since piston 62 extends rearwardly to the rearward end of outermost boom segment 30, clearance must be provided by mounting plate 66; hence a V-shaped design has been found to be advantageous.

Figure 8:
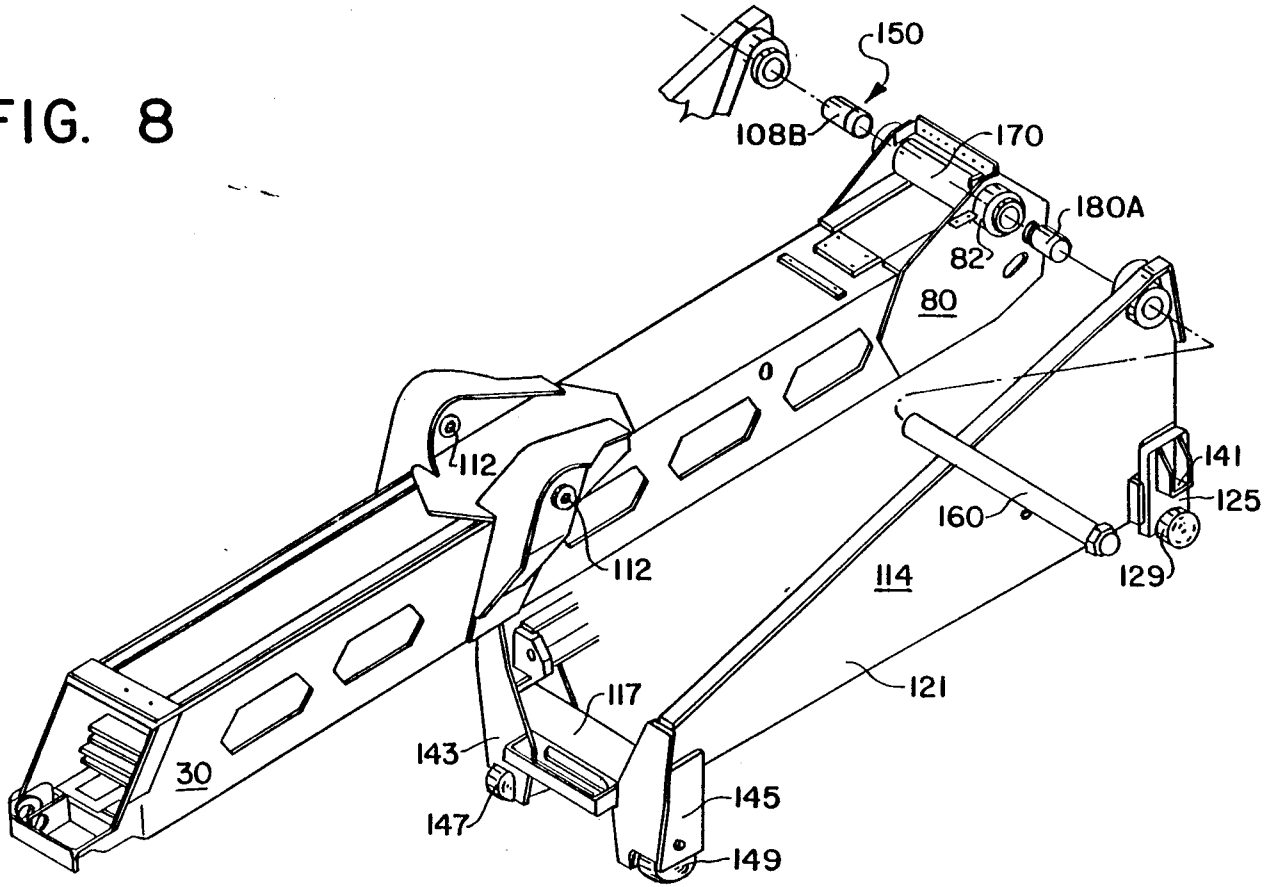
FIG. 8 is an exploded perspective view of the outermost boom segment detailing its pivotable connection to the frame of the vehicle.
Figure 8A:
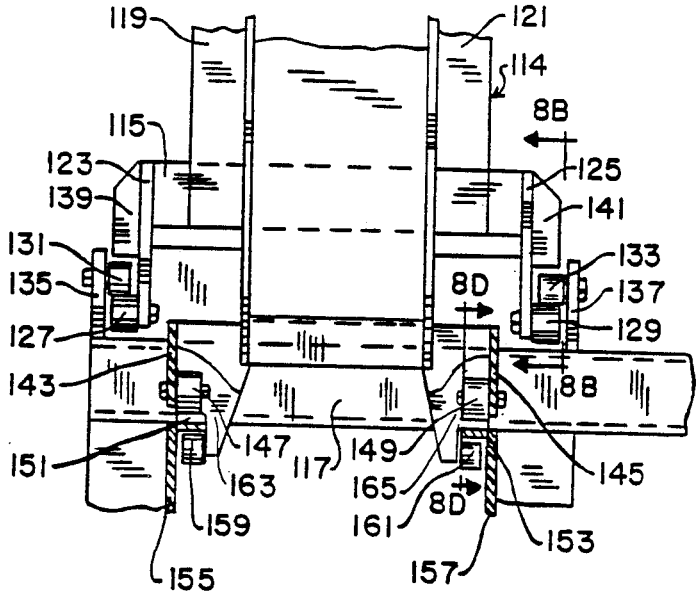
FIG. 8A is a view taken along lines 8A—8A of FIG. 1 of the transfer carriage rollers and supporting track rails.
Figure 8B:
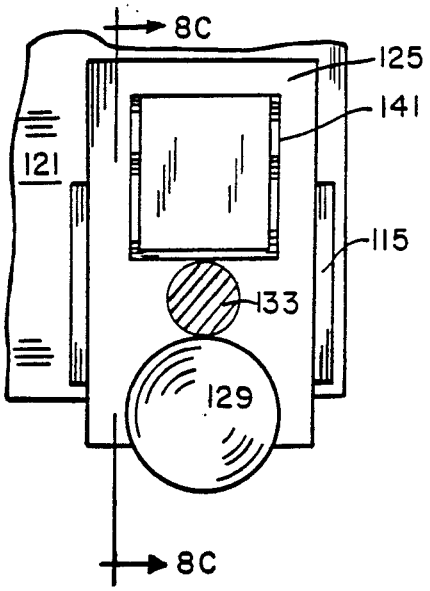
FIG. 8B is a side view of the rear roller of the transfer carriage and corresponding track rail taken along lines 8B—8B of FIG. 8A.
Figure 8C:
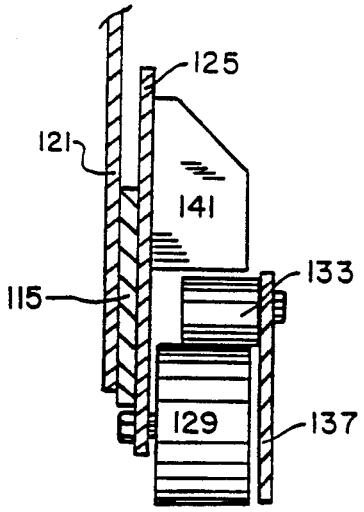
FIG. 8C is an enlarged view of the roller and track rail of FIG. 8B.
Figure 8D:
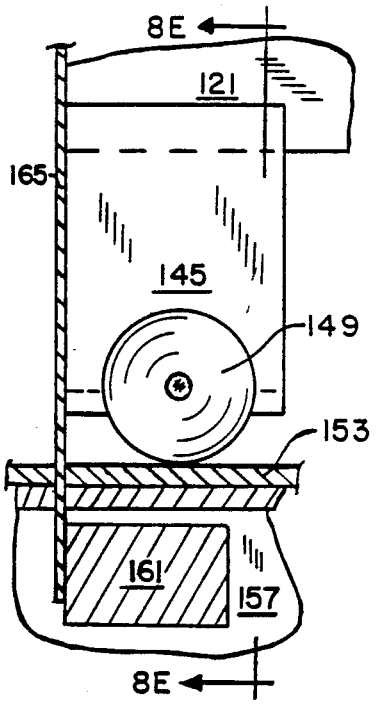
FIG. 8D is a side view of the front roller of the transfer carriage and a corresponding track rail taken along lines 8D—8D of FIG. 8A.
Figure 8E:
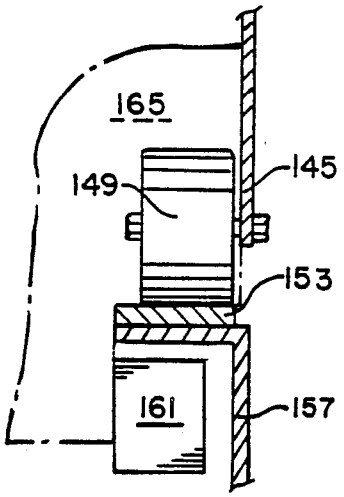
FIG. 8E is an enlarged view of the roller and track rail of FIG. 8D.

Referring now to FIG. 8, there is illustrated a detail of the pivotal connection between outermost boom segment 30 and longitudinal transfer carriage 114. As noted above, longitudinal movement of transfer carriage 114 preferably is accomplished by the use of a track rail arrangement as disclosed in Lull U.S. Pat. No. 4,147,263, although other known longitudinal movement systems may alternately be used.

This track rail arrangement is further illustrated in FIGS. 8A through 8E. Transfer carriage 114 includes a rear beam 115 and forward beam 117 welded to the opposite ends of plates 119 and 121. Rear beam 115 extends outwardly from plates 119 and 121 and supports a pair of parallel spaced apart longitudinally extending vertical roller plates 123 and 125, each of which carries a roller 127 and 129, respectively. Rollers 127 and 129 engage the bottom surfaces of hardened rails or tracks 131 and 133, respectively, which are removably secured to parallel spaced apart vertical longitudinally extending plates 135 and 137 which are part of the vehicle frame. The top surfaces of rails 131 and 133 are engaged by wear pads 139 and 141 carried by carriage plates 123 and 125, respectively.

A pair of parallel spaced apart longitudinally extending vertical forward roller plates 143 and 145 are supported from and extend downwardly from the forward end of the transfer carriage 114. Plates 143 and 145 support rollers 147 and 149, respectively, which engage hardened rails or tracks 151 and 153, respectively, which are removably secured to the top surfaces of flanged beams 155 and 157, respectively, forming part of the vehicle frame. Guide rollers 159 and 161 supported by transverse plates 163 and 165 are carried by the forward end of the transfer carriage 114 and engage the undersurfaces of the flanges of beams 155 and 157, respectively.

The transfer carriage 114 is reciprocated longitudinally on tracks 131, 133 and 151, 153 by a hydraulic cylinder fixed at one end to a transverse plate at the forward end of the carriage and fixed at its other end to frame. Forward rails or tracks 151, 153 are spaced downwardly and inwardly rom rear rails or tracks 131, 133. This stepped track arrangement provides improved operator visibility. At the same time, the narrower front frame made possible by the inwardly stepped forward transfer rails permits a wider more comfortable operator compartment and permits the use of dual front wheels without increasing the overall width of the loader. The transfer carriage 114 can be reciprocated the full length of the frame.

Boom 14 and in particular outermost boom segment 30 includes means for connecting a hydraulic cylinder/-piston arrangement which is used for lifting or lowering the boom. These connection means, shown as apertures 112, are located on opposite sides of the upper central section of outermost boom segment 30, and are similar to those disclosed in Lull U.S. Pat. No. 4,147,263.

Outermost boom segment 30 also includes means for pivotal connection of the boom 14 to the transfer carriage. This pivotal connection means 150 primarily includes pin 160, tubular channel 170 and bushings 180. Bushings 180A, 180B are made of a wear resistant material such as bronze, and extend only partially into channel 170 at each end, thus leaving an open area inside channel 170. This space minimizes the buildup of corrosion products between the pin 60 and bushings 180A, 180B. Pin 160 extends through an aperture in the transfer carriage side plates, through an aperture 82 in support flange 80 and through bushings 180A, 180B. Support flange 80 securely connects channel 170 to outermost boom segment 30 to enable the boom to be pivoted upwardly or downwardly. Pin 160 remains stationary during the lifting and lowering cycles of the boom 14; instead channel 170 rotates on bushings 180A, 180B to achieve the desired pivoting motion of the boom 14.

Figure 9B:
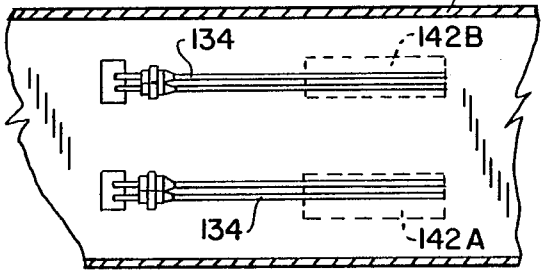
FIGS. 9, 9A and 9B are three views of an assembly for preventing entanglement of the flexible hydraulic hoses which extend from the vehicle through and to the front end of the boom.
Figure 9A:
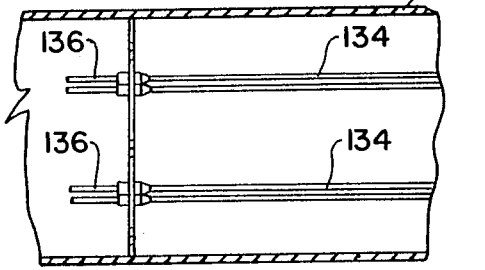
Figure 9:
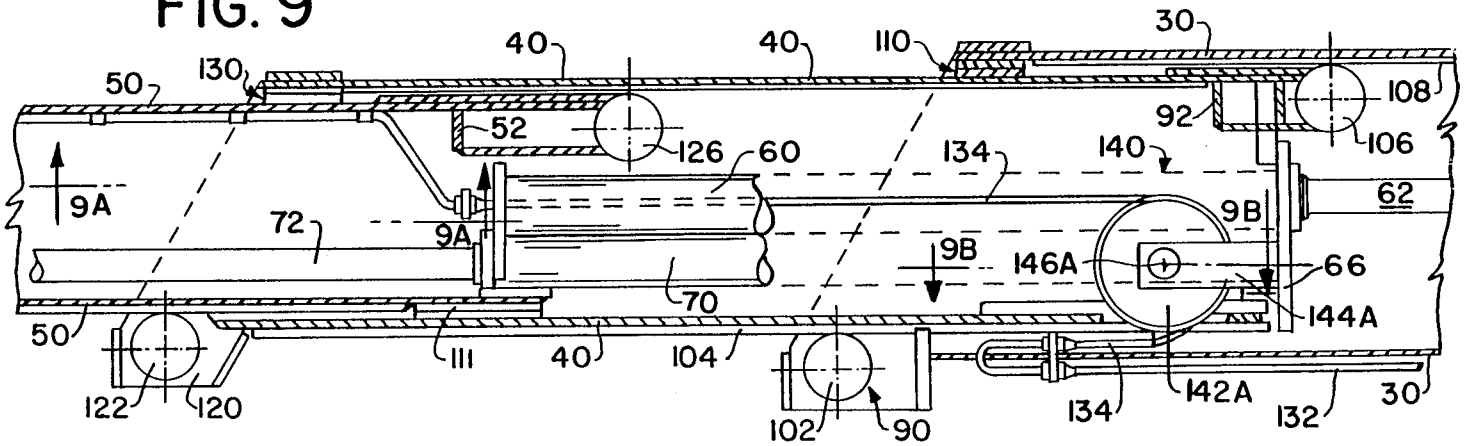

Referring now to FIG. 9, there is illustrated a pulley assembly 140 for preventing entanglement and/or damage to the hydraulic hosing which is used for providing hydraulic fluid to the cylinder which operates the end effector means. The hydraulic hosing includes steel or aluminum tubing 132 extending from a supply on the vehicle and mounted on the bottom of the outermost boom segment 30, flexible hose 134 through the intermediate boom segment 40, and steel or aluminum tubing 136 through the innermost boom segment 50 for supplying hydraulic fluid to the forklift cylinder.

FIGS. 9A and 9B show the layout of the metal tubing 132, 136 on the respective boom segments 30, 50. The tubing 132 on the underside of the bottom of the outermost boom segment 30 extends forward of the sheaves or pulleys 142A, 142B and then reverses its direction 180° through the boom segment wall to turn back towards the pulleys. Flexible hose 134, preferably of an elastomer which has suitable chemical resistance to hydraulic fluid and sufficient flexibility to be bent without kinking or collapsing, then extends from the end of tubing 134, around pulleys 142A, 142B and thereafter to the rearward end of tubing 136. Tubing 136, attached to the top plate member of innermost boom segment 50, then extends to the forklift cylinder as previously described.

Pulleys 142A, 142B are rotatably mounted upon mounting plate 66 through the use of a bracket 144A, 144B and pin 146A, 142B so that it rides on the bottom surface of the outermost boom segment 30, from a position when the boom segments are fully extended, as shown in FIG. 9, to one corresponding to fully retracted boom segments where the pulleys 142A, 142B are located at the most rearward end of the outer boom segment 30. Preferably, the flexible hose 134 is wrapped about 180° around the pulley to reverse its direction. Thus, movement of the intermediate boom segment 40 corresponds to the movement of the pulleys 142A, 142B. Tension is maintained on this system through the use of cables 56, 58 and pulleys 42, 44, as described previously.

Figure 10C:
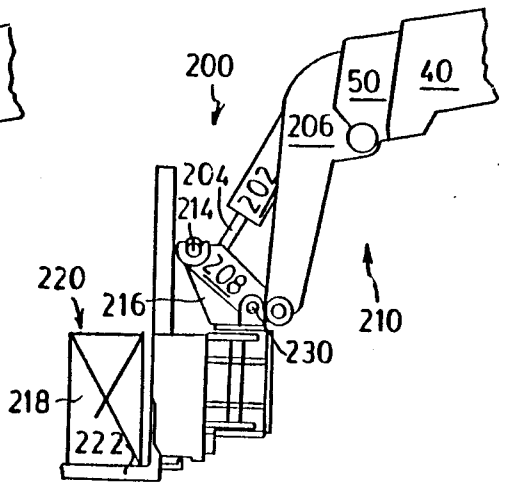
FIGS. 10A, 10B and 10C are three views of a quick-attach system for mounting end effector means such as forklifts at the front or working end of the innermost boom segment.
Figure 10B:
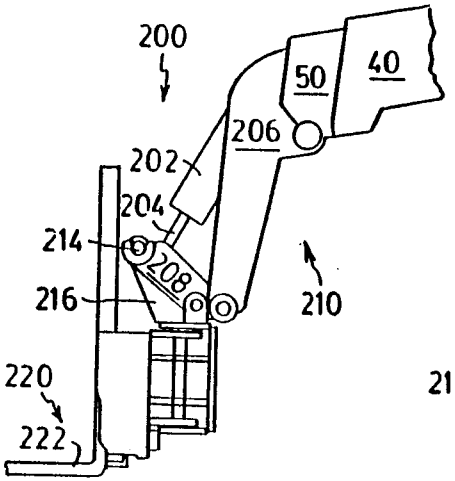
Figure 10A:
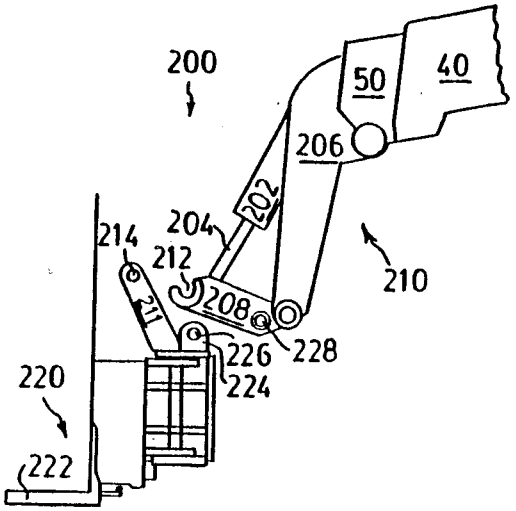

FIGS. 10A, 10B and 10C illustrate a preferred quick connection/disconnection system 200 for removably attaching end effector means upon the front or working end of the inner boom segment 50. As shown, the inner boom segment 50 includes an adapter 210 which includes a hydraulic cylinder 202 and piston 204 arrangement, along with support arm 206 and connecting arm 208. Connecting arm 208 includes a pair of U-shaped receiving pads 212 for mating engagement with a pair of pins 214 on the end effector means 220, shown in this FIG. as forklift 222. Pins 214 are attached by support bracket 216 to forklift 222. A second bracket 224 includes an aperture 226 which is configured and positioned for alignment with aperture 228 of connecting arm 208. As adapter 210 is brought near and adjacent to end effector means 220, receiving pads 212 receive and engage pins 214, as best shown in FIG. 10B. Thereafter, arm 208 is positioned so that two sets of apertures (one set of which is shown as 224 and 228) are aligned, with a pair of locking pins (one of which is shown as 230) then automatically inserted into the aligned sets of apertures 224, 228 by a hydraulic cylinder to complete the connection and to enable the boom to transport a load 218, as shown in FIG. 10C.

To change end effector means 220, pins 230 are removed by the same hydraulic cylinder, and adapter 210 is disengaged from the end effector means 220. Thus, versatility in the speed of connection and types of end effector means 220 are provided to the vehicle.

In addition to the quick connect/disconnect arrangement for the end effector means described herein, other arrangements, such as those disclosed in U.S. Pat. No. 4,251,181 can also be used. Thus, the disclosure of that patent is also expressly incorporated herein by reference thereto.

A hydraulic flow splitting device is provided to maintain the fork lift level through all operating positions. In order to maintain the angular orientation of the fork lift at a predetermined attitude, usually 2°, with respect to the vehicle 10, hydraulic flow-splitting devices such as those disclosed in Lull U.S. Pat. No. 4,683,802 or Lull U.S. Pat. No. 4,185,357 , can be used.

Figure 11:
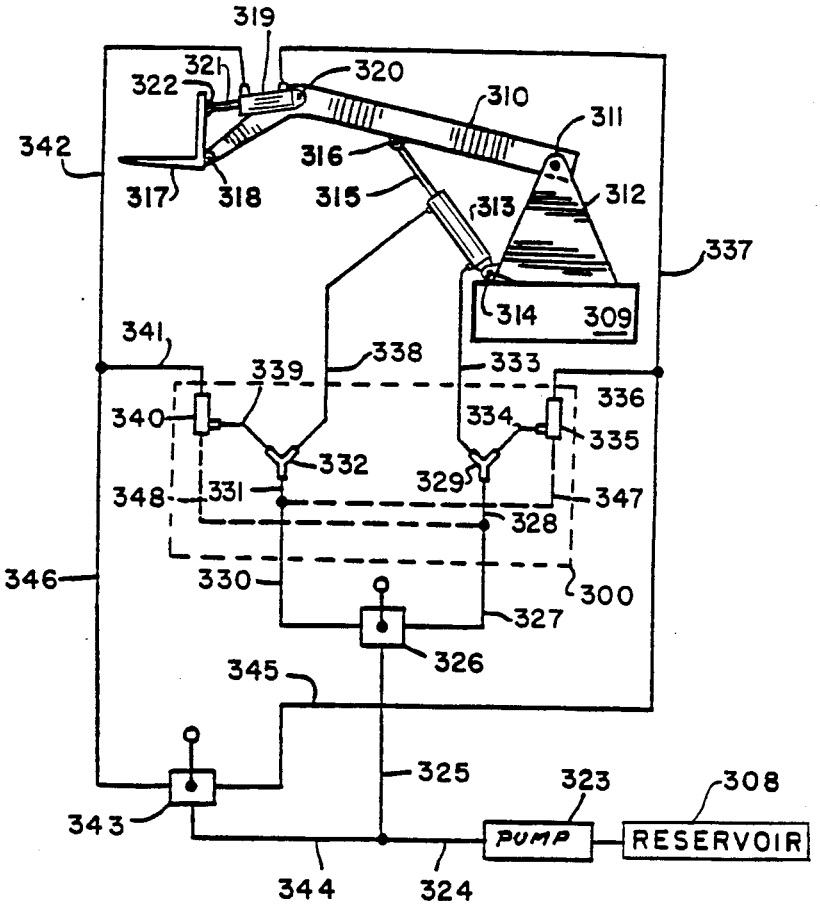
FIG. 11 is a schematic representation of a self-leveling hydraulic fluid flow system.

FIG. 11 illustrates the self-leveling system of the present invention in simplified schematic form. Boom 310 is pivotally connected at 311 to transfer carriage 309. Boom 310 is raised and lowered by means of an hydraulic cylinder 313 pivotally connected at 314 to the transfer carriage 309. Rod 315 of the cylinder is pivotally connected at 316 to the boom 310. Fork 317 is tilted about pivot 318 by means of a tilt cylinders 319 pivotally connected at 320 to boom 310. The rod 321 of cylinder 319 is pivotally connected at 322 to the fork 317.

The term "end effector means" is used to generally describe any load carrying apparatus which is attached to the forward end of the boom 310, which apparatus must be maintained at a predetermined angle throughout the lifting cycle of boom 310. Such apparatus include forks (as shown), buckets, personnel carrying baskets, towers, and the like. Also, "end effector means" contemplates tools, such as drills and augers, which may be positioned at a remote work site and which must be maintained in a particular orientation to carry out their appropriate function.

As is well understood, current practice is to direct hydraulic fluid to the piston ends of cylinders 313 and 319 during the boom "up" mode of operation and to the rod end during the boom "down" mode. Since the volume requirements of hydraulic fluid under pressure of the boom and carriage are reasonably proportional throughout the operating range, the object of the system of the present invention is to utilize an adjustable, divided flow of oil or comparable hydraulic fluid to create a condition of self-leveling. The exactness to which such a system operates is dependent on the geometric results of incremental length changes of the operating cylinders and the accuracy obtainable from the flow dividing devices under variable pressures and rates of flow. For example, spool valves generally operate more precisely at higher fluid flow due to the presence of higher fluid pressure differentials. This invention provides adjustment means, preferably associated with each spool valve, to "fine-tune" the flow ratios in order to obtain more accuracy in the parallelism, that is, the attitude of the end effector means is precisely controlled and maintained throughout the entire boom raising and lowering cycle.

Although for ease of explanation the system is shown as including one boom hoist cylinder and one end effector tilt cylinder, in many or most instances a pair of hoist cylinders are used and a pair of tilt cylinders may be used.

Hydraulic fluid, such as oil, flows under pressure from a reservoir 308 through pump 323 and through flow lines 324 and 325 to a manually operable boom hoist control valve 326 by which the mobile loader operator controls the upward and downward movement of the boom 310. From control valve 326, the oil is directed through flow lines 327, 328 to a first flow divider 329, or through flow lines 330 and 331 to a second flow divider 332. The first flow divider 329 controls the "up" mode of operation of the boom and the second flow divider 332 controls the "down" mode. In the "up" mode, the greater proportion of oil is pumped through flow lines 333 to the piston side of hoist cylinder 313 to elevate boom 310. The lesser proportion of oil is pumped through flow line 334, check valve 335 and flow lines 336, 337 to the piston side of the end effector means tilt cylinder 319. During the "down" mode, the greater proportion of oil flow from the second flow divider 332 is pumped through flow line 338 to the rod side of hoist piston 313. The lesser portion of oil flow is pumped through flow line 339, check valve 340 and flow lines 341, 342 to the rod side of the tilt cylinder 319.

It is common practice for hydraulic cylinders to contain pilot operated safety check valves to retain fluid in the cylinders in the event of hose rupture or similar accident. As fluid is introduced to one side of the piston in a cylinder, there is a reverse flow of the fluid from the opposite side of the piston through the flow circuitry back to a reservoir. The pressure exerted by the incoming fluid must be sufficient to overcome the safety check valves to permit reverse flow.

Tilting of fork 317 independently of up or down movement of the boom is accomplished by means of a manual tilt control valve 343. Oil from pump 323 passes through flow lines 324 and 344 to the manual control 343. To tilt fork 317 forward, oil is pumped through flow lines 345 and 337 to the piston side of tilt cylinder 319. Check valves 335 and 340 function whenever the carrige is being independently adjusted to prevent the inadvertent flow of oil to the boom operating cylinder through the flow dividers.

The check feature of valves 335 and 340 is removed for reverse flows during the self-leveling mode by pressure generated in the opposite incoming stream. This pressure mechanically opens the check valves 335 and 340 through a pilot control port, as explained in greater detail hereinafter. As an illustration, in the "up " mode, as pressure is exerted upon the piston side of the hoist and tilt cylinders, a reverse pressure is exerted by the oil being forced from the rod sides of those cylinders. The oil from the rod side of tilt cylinder 319 is permitted to flow backwardly through check valve 340 because of the greater pilot pressure on that valve due to connection to the hoist pressure line.

In FIG. 11, box 300 defines the unitary combination of the various components which are preferably used as a single compact valve assembly.

An override control enables the operator to change the attitude of the end, effector means at any time, even during the self-leveling mode. As also seen in FIG. 11, the oil directed by the override control is brought into the system downstream of the flow dividers 329 and 332 by means of flow lines 347 and 348, respectively. Override relief valves are incorporated in the body of the override control and serve to relieve divided oil flow in the event the carriage cylinder comes to the fully extended or collapsed configuration. Otherwise the boom cylinder would stop the instant the tilt cylinder stopped.

The cylinder area ratios are intentionally matched to produce the same geometric changes in both the "up" and "down" modes. This prevents errors in the flow division from accumulating on each cycle. To the extent necessary to further describe such hydraulic flow-splitting systems, the content of each of those documents is expressly incorporated herein by reference thereto.

While it is apparent that the invention herein disclosed is well calculated to fulfill the objects above stated, it will be appreciated that numerous embodiments and modifications may be devised by those skilled in the art, and it is intended that the appended claims cover all such modifications and embodiments as fall within the true spirit and scope of the present invention.

What is claimed is:

1. A variable reach rough terrain load lifting apparatus comprising:

a vehicle having a frame;

a boom comprising innermost, intermediate and outermost telescoping boom segments, said intermediate boom segment having first and second hydraulic cylinders mounted therein, said first hydraulic cylinder connecting said outermost and intermediate boom segments for extending and retracting said intermediate boom segment, and said second hydraulic cylinder connecting said intermediate and innermost boom segments for extending and retracting said innermost boom segment, said innermost boom including end effector means attached to the forward end thereof;

fluid conduit means extending through said boom segments at least a portion of which includes flexible hose extending from a first position fixed on said innermost boom segment to a second portion fixed on said outermost boom segment for directing hydraulic fluid through said boom to said end effector means, said intermediate boom segment further comprising a pair of pulleys positioned on opposite sides of said hydraulic cylinders in a rearward portion of said intermediate boom segment, said pulleys contacting said flexible hose and traveling between first and second positions for preventing entanglement of said flexible hose when said innermost and intermediate boom segments are extended or retracted;

means for pivotal connection of the boom to the vehicle frame and capable of reciprocal longitudinal movement therewith, while preventing buildup of corrosion products which would interfere with the pivotal movement of said boom with respect to said vehicle and further facilitating repair or replacement thereof due to normal operation;

means for elevating and lowering said boom;

means for reciprocating longitudinal movement of said boom and pivotal connection means with respect to said vehicle frame; and means for stabilizing said vehicle when said boom is extended.

2. The apparatus of claim 1 further comprising means for maintaining said end effector means at a predetermined attitude with respect to the vehicle frame.

3. The apparatus of claim 1 wherein said end effector means includes means for quick connection and disconnection to and from the forward end of said innermost boom segment.

4. The apparatus of claim 1 wherein said means for elevating and lowering said boom comprises a pair of hydraulic cylinders each connected to an outer portion of the outermost boom.

5. The apparatus of claim 1 wherein said reciprocating longitudinal movement means comprises a transfer carriage mounted upon said vehicle frame for reciprocating longitudinal movement therewith, wherein said boom is pivotally connected to said transfer carriage.

6. The apparatus of claim 5 wherein said vehicle frame includes two pair of track rails for supporting said transfer carriage and to facilitate said reciprocating longitudinal movement between said carriage and vehicle frame.

7. The apparatus of claim 1 further comprising fluid pressure actuating means at the forward end of said innermost boom segment for operating said end effector means.

8. The apparatus of claim 1 wherein the hose entanglement preventing means comprises at least one hose pulley assembly rotatable attached to said intermediate boom segment for engaging said flexible hose.

9. A variable reach rough terrain load lifting apparatus comprising:

a vehicle having a frame;

a boom comprising innermost, intermediate and outermost telescoping boom segments, said intermediate boom segment having first and second hydraulic cylinders mounted therein, said first hydraulic cylinder connecting said outermost and intermediate boom segments for extending and retracting said intermediate boom segment, and said second hydraulic cylinder connecting said intermediate and innermost boom segments for extending and retracting said innermost boom segment, said innermost boom including end effector means attached to the forward end thereof;

means for interconnecting the innermost, intermediate and outermost boom segments so that the innermost and intermediate boom segments can be extended or retracted in unison, said interconnecting means comprising first cable means connecting a forward portion of the outermost boom segment with a rearward portion of the innermost boom segment through first pulley means mounted on a rearward portion of the intermediate boom segment, and second cable means connecting a rearward portion of said innermost boom segment with a rearward portion of said outermost boom segment through second pulley means located on a forward portion of said intermediate boom segment, said first and second cable means and pulley means maintaining tension between said outermost, intermediate, and innermost boom segments during extension and retraction thereof;

means for pivotal connection of the boom to the vehicle frame;

means for elevating and lowering said boom;

means for reciprocating longitudinal movement of said boom and pivotal connection means with respect to said vehicle frame; and means for stabilizing said vehicle when said boom is extended.

10. The apparatus of claim 1 wherein the pivotal connection means comprises a pair of spaced bushings located in an elongated opening in said outermost boom segment, and a pin extending through said elongated opening and connected at each end to support means capable of reciprocating longitudinal movement with said vehicle frame.

11. The apparatus of claim 1 wherein the stabilizing means comprises a pair of outriggers located on opposite sides of the front of said vehicle frame.

12. A variable reach rough terrain load lifting apparatus comprising:

a vehicle having a frame;

a boom comprising innermost, intermediate and outermost telescoping boom segments, said intermediate boom segment having first and second hydraulic cylinders mounted therein, said first hydraulic cylinder connecting said outermost and intermediate boom segments for extending and retracting said intermediate boom segment, and said second hydraulic cylinder connecting said intermediate and innermost boom segments for extending and retracting said innermost boom segment, said innermost boom including end effector means attached to the forward end thereof;

pivotal connection means for connecting the outermost boom segment to the vehicle frame and capable of reciprocal longitudinal movement therewith, said pivotal connection means comprising a pair of bushings located in spaced relation in a tubular channel extending between a pair of support plates and through said outermost boom segment, and a pin extending through said tubular channel and connected at each end to said support plates, said support plates, tubular channel capable of reciprocating longitudinal movement with said vehicle frame, said pivotal connection means facilitating pivotal movement of said boom with respect to said vehicle with the space between said bushings preventing buildup of corrosion products which would interfere therewith, said spaced bushings further facilitating repair or replacement of said pivotal connection means due to normal operation;

a pair of hydraulic cylinders for elevating and lowering said boom;

means for reciprocating longitudinal movement of said boom, pivotal connection means, and support plates with respect to said vehicle frame; and a pair of outriggers located on opposite sides of the front end of said vehicle for stabilizing the vehicle when said boom is extended.

13. The apparatus of claim 12 wherein each outrigger comprises a hydraulic cylinder and support pad arrangement, wherein the extension of the cylinder causes the support pad to contact a support surface for providing upward stabilizing forces to the front end of said vehicle.

14. The apparatus of claim 12 further comprising means for maintaining said end effector means at a predetermined angle with respect to the vehicle frame.

15. The apparatus of claim 12 wherein said end effector means includes means for quick connection and disconnection to and from the forward end of said innermost boom segment.

16. The apparatus of claim 12 wherein said reciprocating longitudinal movement means comprises a transfer carriage mounted upon said vehicle frame for reciprocating longitudinal movement therewith, wherein said boom is pivotally connected to said transfer carriage.

17. The apparatus of claim 16 wherein said vehicle frame includes two pair of track rails for supporting said transfer carriage and to facilitate said reciprocating longitudinal movement between said carriage and vehicle frame.

18. The apparatus of claim 12 further comprising fluid pressure actuating means at the forward end of said innermost boom segment for operating said end effector means.

19. The apparatus of claim 18 further comprising fluid conduit means extending through said boom segments from a source of fluid under pressure in said vehicle to said fluid pressure actuating means, at least a portion of said fluid conduit means being flexible hose.

20. The apparatus of claim 19 further comprising means for preventing entanglement of said flexible hose when said innermost and intermediate boom segments are extended or retracted.

21. The apparatus of claim 20 wherein the hose entanglement preventing means comprises at least one hose pulley assembly rotatable attached to said intermediate boom segment for engaging said flexible-hose.

22. The apparatus of claim 12 further comprising means for interconnecting the innermost, intermediate and outermost boom segments so that the innermost and intermediate boom segments can be extended or retracted in unison.

23. A variable reach rough terrain load lifting apparatus comprising:

a vehicle having a frame;

a boom comprising innermost, intermediate and outermost telescoping boom segments, said intermediate boom segment having first and second hydraulic cylinders connected to each other and mounted therein, said first hydraulic cylinder connecting said outermost and intermediate boom segments for extending and retracting said intermediate boom segment, and said second hydraulic cylinder connecting said intermediate and innermost boom segments for extending and retracting said innermost boom segment, wherein said outermost and innermost boom segments are interconnected by means for maintaining tension therebetween comprising cable means operatively associated with pulley means mounted upon said intermediate boom segment for extension and retraction of said innermost and intermediate boom segments in unison; said innermost boom including end effector means attached to the forward end thereof, said end effector means including means for quick connection and disconnection to and from the forward end of said innermost boom segment, and fluid pressure actuating means at the forward end of said innermost boom segment for operating said end effector means comprising fluid conduit means extending through said boom segments to said actuating means, at least a portion of said fluid conduit means being flexible hose;

means for preventing entanglement of said flexible hose when said innermost and intermediate boom segments are extended or retracted comprising a pulley assembly attached to said intermediate boom segment for engaging said flexible hose;

pivotal connecting means for connecting the outermost boom segment to the vehicle frame and capable of reciprocal longitudinal movement therewith, said pivotal connection means comprising a pair of bushings located in spaced relation in a tubular channel extending between a pair of support plates and through said outermost boom segment, and a pin extending through said tubular channel and connected at each end to said support plates, said support plates, tubular channel capable of reciprocating longitudinal movement with said vehicle frame, said pivotal connection means facilitating pivotal movement of said boom with respect to said vehicle with the space between said bushings preventing buildup of corrosion products which would interfere therewith, said spaced bushings further facilitating repair or replacement of said pivotal connection means due to normal operation;

a pair of hydraulic cylinders connected to said outermost boom segment for elevating and lowering said boom;

means for reciprocating longitudinal movement of said boom, pivotal connection means and support plates with respect to said vehicle frame; and a pair of outriggers located on opposite sides of the front end of said vehicle for stabilizing the vehicle when said boom is extended, each outrigger comprising a hydraulic cylinder and support pad arrangement, wherein extension of surface for providing upward stabilizing forces to the front end of said vehicle.

24. The apparatus of claim 13 wherein said quick connection and disconnecting means comprises:

rod means attached to said end effector means;

U-shaped engagement means attached to the forward end of said innermost boom segment for receiving said rod means; and means for locking said end effector means to said innermost boom segment after said engagement means receives said rod means and when said end effector means is positioned in alignment with said innermost boom means.

25. The apparatus of claim 24 wherein the locking means comprises a pair of pins each of which is movable by hydraulic means to engage a set of apertures, one aperture located on said end effector means and the other located on said innermost boom segment forward end.

26. The apparatus of claim 23 further comprising means for maintaining said end effector means at a predetermined attitude with respect to the vehicle frame.

27. The apparatus of claim 23 wherein said reciprocating longitudinal movement means comprises a transfer carriage mounted upon said vehicle frame for reciprocating longitudinal movement therewith, wherein said boom is pivotally connected to said transfer carriage.

28. The apparatus of claim 27 wherein said vehicle frame includes two pair of track rails for supporting said carriage to facilitate said reciprocating longitudinal movement between said carriage and vehicle frame.

29. The apparatus of claim 25 wherein said pulley assembly comprises a pair of hose pulleys attached to a rear portion of said intermediate boom segment.

30. The apparatus of claim 23 wherein said cable means comprises a pair of cables each attached at one end to the outermost boom segment and at the other end to the innermost boom segment, each of said cables engaging a pulley rotatably attached to the intermediate boom segment.

31. A variable reach rough terrain load lifting apparatus comprising:

a vehicle having a frame;

a boom comprising innermost, intermediate and outermost telescoping boom segments, said intermediate boom segment having first and second hydraulic cylinders connected to each other and mounted therein, said first hydraulic cylinder connecting said outermost and intermediate boom segments for extending and retracting said intermediate boom segment, and said second hydraulic cylinder connecting said intermediate and innermost boom segments for extending and retracting said innermost boom segment, said intermediate boom segment including cable means for interconnecting said outermost and innermost boom segments so that extension and retraction of said innermost and intermediate boom segments can be made in unison, said innermost boom including end effector means attached to the forward end thereof;

fluid conduit means extending through said boom segments at least a portion of which includes flexible hose extending from a first position fixed on said innermost boom segment to a second portion fixed on said outermost boom segment for directing hydraulic fluid through said boom to said end effector means, said intermediate boom segment further comprising a pulley assembly for contacting said flexible hose and traveling between first and second positions for preventing entanglement of said flexible hose when said innermost and intermediate boom segments are extended or retracted;

means for pivotal connection of the boom to the vehicle frame and capable of reciprocal longitudinal movement therewith, while preventing buildup of corrosion products which would interfere with the pivotal movement of said boom with respect to said vehicle and further facilitating repair or replacement thereof due to normal operation;

means for elevating and lowering said boom;

means for reciprocating longitudinal movement of said boom and pivotal connection means with respect to said vehicle frame; and means for stabilizing said vehicle when said boom is extended.

* * * * *